US005267459A

United States Patent [19]

Sedley

[11] Patent Number: 5,267,459

[45] Date of Patent: Dec. 7, 1993

[54] MAGNETIC KEY OPERATED LOCK

[76] Inventor: Bruce S. Sedley, 24 Broadway, 8th Floor, Flat A, Mei Foo Sun Chuen, Kowloon, Hong Kong

[21] Appl. No.: 743,398

[22] PCT Filed: Feb. 15, 1990

[86] PCT No.: PCT/GB90/00246

§ 371 Date: Oct. 3, 1991

§ 102(e) Date: Oct. 3, 1991

[87] PCT Pub. No.: WO90/09503

PCT Pub. Date: Aug. 23, 1990

[30] Foreign Application Priority Data

Feb. 15, 1989 [GB] United Kingdom ..... 8903441
Feb. 1, 1990 [GB] United Kingdom ..... 9002222

[51] Int. Cl.[5] ..... E05B 25/00; E05B 47/00

[52] U.S. Cl. ..... 70/276; 70/383; 70/384

[58] Field of Search ..... 70/276, 382-385, 70/413

[56] References Cited

U.S. PATENT DOCUMENTS 3,566,637 3/1971 Hallmann ..... 70/413 X
4,312,198 1/1982 Sedley ..... 70/276
5,012,659 5/1991 Eisermann ..... 70/276
5,072,604 12/1991 Eisermann ..... 70/276
5,074,135 12/1991 Eisermann ..... 70/276

FOREIGN PATENT DOCUMENTS 0024242 2/1983 European Pat. Off. .
0276444 8/1988 European Pat. Off. .
0304760 3/1989 European Pat. Off. ..... 70/276

*Primary Examiner*—Lloyd A. Gall
*Attorney, Agent, or Firm*—Eckert Seamans Cherin & Mellott

[57] ABSTRACT

In a magnetic key operated lock, a slide member carries a plurality of wheels in which are mounted magnetic pins. The position of the pins forms part of a code of the lock. The wheels are caused to rotate by insertion of a code changing key, which has a code for unlocking the lock, and moving the slide member. As the slide member moves, one of the pins which is repelled by the particular code changing key abuts a stop, which thus causes the respective wheel, and so the other wheels, to rotate. By having wheels of two different diameters, the smaller wheels can be made to rotate more than once before a code is repeated. The stops are formed by pressing a tang from a stationary wall in the lock.

10 Claims, 14 Drawing Sheets

MAGNETIC KEY OPERATED LOCK

BACKGROUND OF THE INVENTION

1. Field of the Invention

The present invention relates to a lock which is operated by a magnetic key and to a key for operating such a lock. One such lock is described in EP0024242.

2. Description of the Related Art

Briefly, in such locks a slide member carries a plurality of tumblers in the form of small cylindrical magnets (magnet pins) which are slidably received in bores in the slide member so as to slide transversely of the direction of movement of the member. In the locked position, the pins are attracted towards a magnetic plate so that they extend part way out of the bores and through apertures in a non-magnetic lock plate which is fixed in position and located between the slide member and magnetic plate. Hence the pins lock the slide member in position relative to the non-magnetic lock plate. To unlock the lock, a magnetic key is slid between the magnetic plate and slide member, and repels the pins so that they are pushed out of the apertures in the lock plate. The slide member is then free to slide relative to the lock plate. The key engages a flange on the slide member so that further movement of the key moves the slide to allow operation of the lock.

The code of the lock is governed by the number, position and polarity of the magnet pins relative to the lock plate. EP0024242 describes a system in which the code of the lock can be changed without dismantling the lock. A rotatable wheel mounted in the slide member carries a magnet pin allowing the pin to be moved between four positions which correspond to four respective apertures in the lock plate. To move the pin, a code changing key is inserted to repel the pins from the lock plate and then move the slide member to a position where the wheel can be rotated by a tool inserted through the outside housing of the lock.

It has been found that if the pin is not moved precisely into one of its four positions it may, when an attempt is made subsequently to operate the lock, be caught in another aperture provided in the lock plate as the slide moves relative to the plate. This can cause further rotation of the wheel but generally results in a spurious code for the lock and a special procedure is sometimes required to repel the pin from the aperture in the lock plate so that the proper code can be set. The system of EP0024242 works well in practice but is time consuming as it requires a special manual operation to change the lock code.

Many hotels now have lock systems in which the lock code is changed automatically for each guest. This is presently done only with electronic locks: by recoding them directly from a central computer at the hotel desk; or by giving the hotel guest a key which carries a different code to that used by the previous guest. In the latter system, the lock runs independently of the central computer and contains a battery powered microprocessor which is programmed to detect the key code. If the code falls in the appropriate position in a list of codes carried in the lock memory the lock will be operated by the key. This system minimises difficulties caused by power failures but requires that a computer at the hotel desk be kept in synchronism with the code changes of all the independent locks at all times so that the hotel management knows which key to issue to a subsequent guest. Errors occur frequently in this system particularly due to electronic malfunctions, which requires resetting of locks that get out of sequence.

SUMMARY OF THE INVENTION

The present invention aims to provide a magnetic key operated lock having a facility for automatically and mechanically changing the lock code without the need for a central computer with on line door locks, or independent locks with electronics or batteries, thus providing the benefits of the electronic systems at a low cost.

A first aspect of the invention provides a magnetic key operated lock comprising a slide member movable from a locked position to an unlocking position with a key having a magnetic code encoded in it, a plurality of magnet pins slidable transversely of the slide member from a first position locking the slide member in said locked position to a second position unlocking said slide member on operation of the lock by a said key, the position and polarity of some or all of the magnet pins forming a code for the lock, a plurality of said magnet pins being mounted in a plurality of rotatable carriers in said lock for moving said pins from a first location to a second location to change the code of the lock from a first code to a second code, said carriers being rotated through a predetermined angle on insertion into said lock of a code changing key having a code changing code encoded in it, wherein at least two of said carriers are caused automatically to rotate through different predetermined angles on insertion of said code changing key, whereby a said carrier is rotated through more than one complete rotation before a code of the lock is repeated.

Other aspects of the invention are set forth in the accompanying independent claims.

Other preferred features and advantages of the invention will be apparent from the following description and the accompanying claims.

BRIEF DESCRIPTION OF THE DRAWINGS

The invention will be further described by way of example only with reference to the accompanying drawings, in which:

FIG. 3);

FIG. 18*a* to 18*l* illustrate the operation of the lock of FIG. 15 and;

DESCRIPTION OF THE PREFERRED EMBODIMENTS

Figure 1:
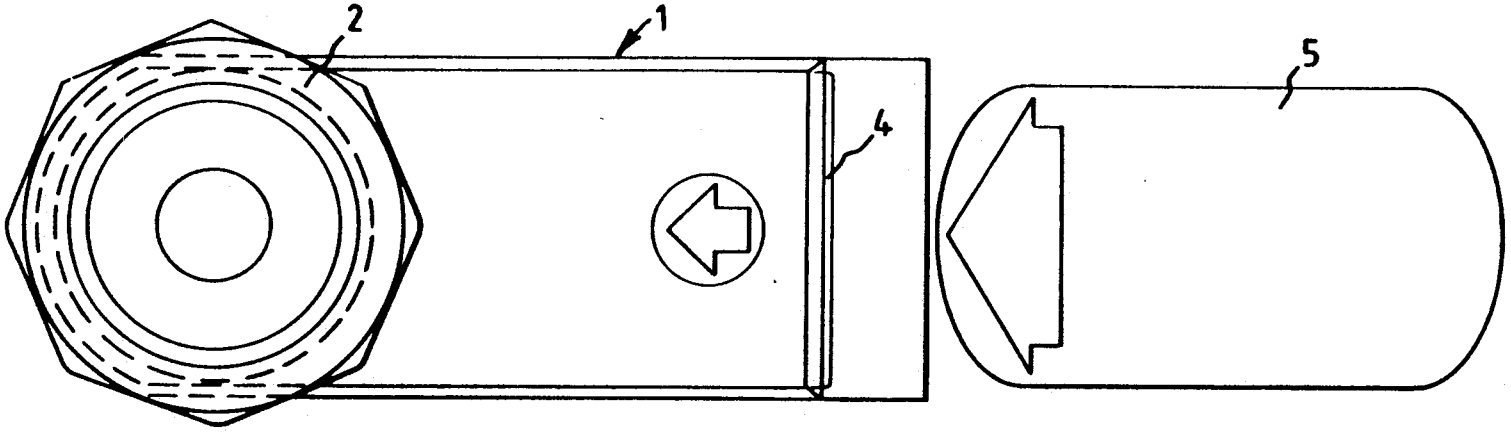
FIG. 1 is a plan view of a magnetic key operated lock and a key.
Figure 2:
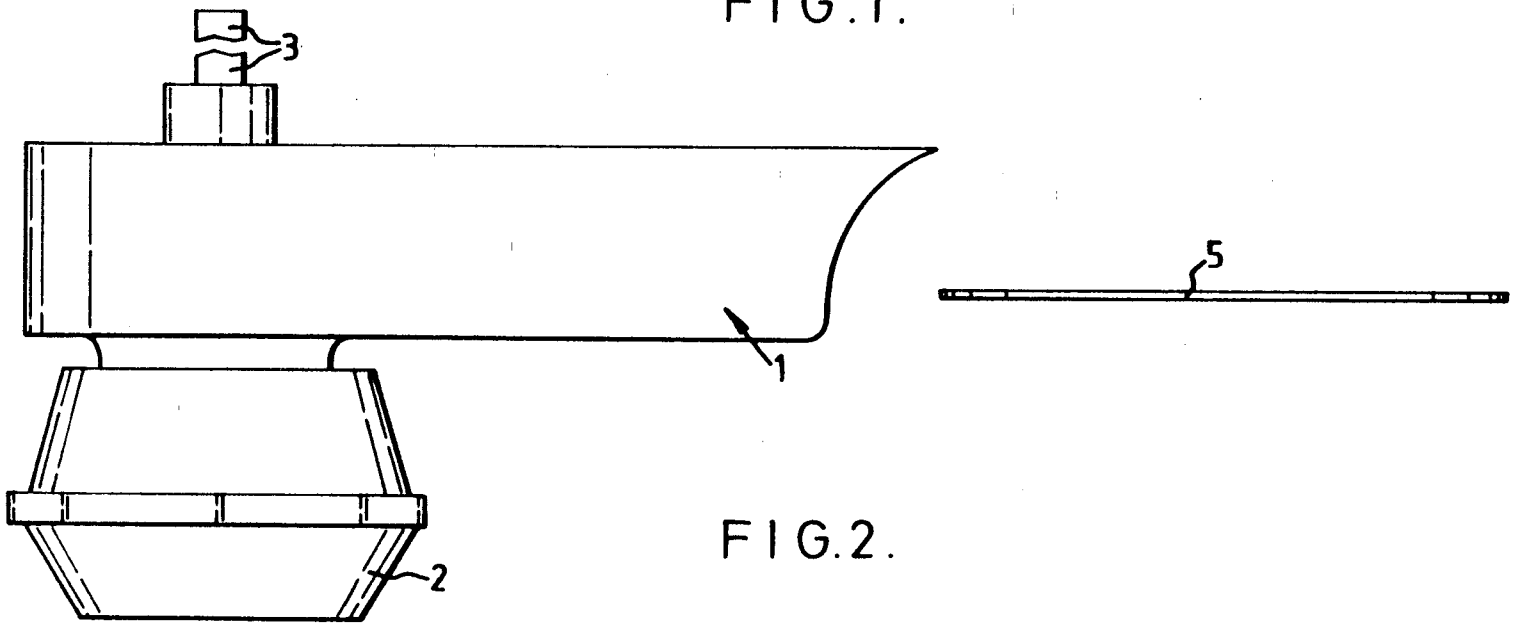
FIG. 2 is a side view of the lock and key of FIG. 1.

Referring to FIGS. 1 and 2 a lock in accordance with the invention comprises an elongate lock case 1 which supports a rotatable knob 2. The knob is arranged to be coupled to a spindle 3 when the lock is in the unlocking position so that rotation of the knob 2 will turn the spindle to retract a latch or bolt (not shown). When the lock is in the locked position the knob 2 is freely rotatable on the case 1 so that the lock cannot be forced. To unlock the lock a magnetic key 5 is inserted in a slot 4 in the case 1. This operation will be described in more detail hereinafter. The key 5 comprises a sheet of magnetic material sandwiched between steel plates. The sheet is magnetised with a plurality of discrete north and south poles on one face which form a code matching the code of the lock, as described for example in U.S. Pat. No. 4,077,242.

Figure 3:
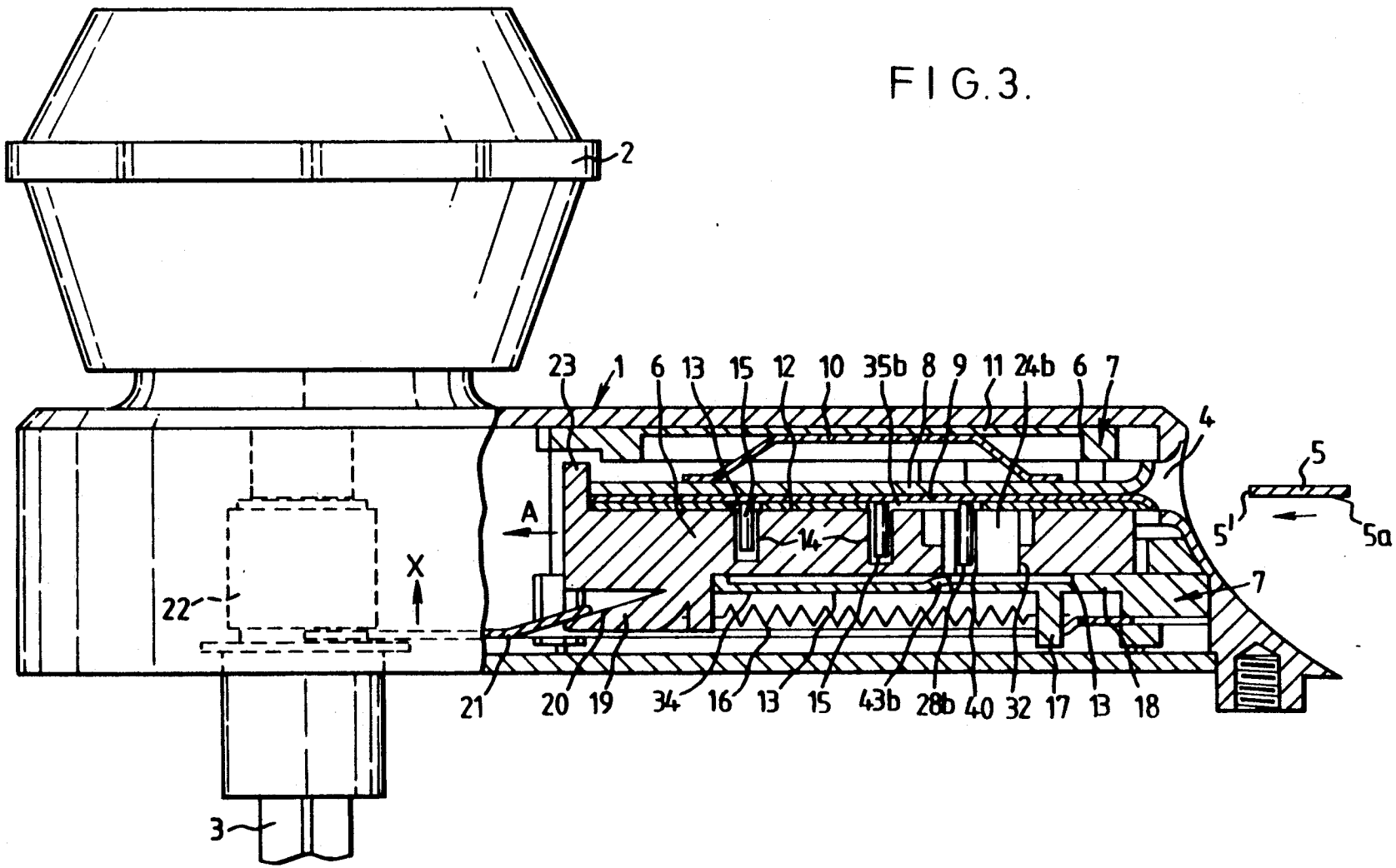
FIG. 3 is a cross-section view of the lock and key of FIG. 1 on enlarged scale along the line III—III of FIG. 6.

Referring to FIG. 3, the case 1 houses an inner case 7 which carries the lock mechanism. The inner case 7 is fixed in position in the case 1.

A slide member 6 is mounted in the inner case 7 and is slidable by the key 5 in the direction of arrow A. The slide member 6 has a plurality of blind bores 14 which are distributed across the plane of the slide member. Tumblers of the lock are formed by magnet pins 15 (small cylindrical permanent magnets) which are accommodated in some or all of the bores 14. Overlaying the open ends of the bores is a lock plate 12 which is fixed in position in the inner case 7 and has apertures 13 which, in the locked position of the slide 6, are aligned with the open ends of the bores 14. A firt guide plate 9 of non-magnetic material, such as brass, overlays the fixed plate 12 and, also, is fixed in position with the plate 12. A second, thicker, guide plate 8 bears on the first guide plate 9 and is biassed against the first plate by a leaf spring 10 supported on a wall 11 of the inner case 7. The second guide plate is of magnetizable material such as ferromagnetic steel.

In the locking position, seen in FIG. 3, the magnet pins 15 are attracted to the second guide plate 8 so that the ends of the pins project into the apertures 13 and abut the first guide plate 9. Hence the slide 6 cannot be slid relative to the lock plate 12. To unlock the lock, a key 5 is slid between the first and second guide plates, 9, 8, the guide plate 8 moving back against the force of the spring 10. The key 5 has a plurality of magnetic poles imprinted on its operating side 5*a*, these poles are positioned so that when the key is fully inserted, its tip 5' abutting a toe 23 on the slide member 6, the poles are arranged opposite the magnet pins 15 and are of the same polarity as the adjacent ends of the pins 15. Hence the pins are pushed out of the apertures 13 by magnetic repulsion and sit on the bottom of the blind bores 14. The slide member 6 is thus unlocked and can be slid by pushing further on the key 5 in the direction of arrow A. A wedge shaped heel 19 on the slide member 6 has a cam surface 20 which depresses a fork 21 which in turn moves a coupling sleeve 22 in the direction of arrow X to connect the knob 2 with the spindle 3 so that the bolt or latch etc. can be opened by rotating the spindle 3. Such an arrangement is described in more detail in EP0241323.

As the key 5 is inserted it rides over two cams 41 which causes the slide member to be held in place when it reaches the unlocking position. This allows the user to release the key and turn the knob 2, and hence open the lock with one hand. When the key 5 is removed, the slide member stays in the unlocking position until the key 5 is withdrawn past the cams 41, (see for example EP0241323).

As the key 5 is fully withdrawn the slide member 6 is pulled to its locked position by a coil spring 16 attached between the heel 19 and a stop 17 on the inner casing 7 (the spring having been tensioned during the forward stroke of the slide member), the magnet pins entering the apertures 13 when the slide member returns to its locked position.

Also seen in FIG. 3 is a movable magnet pin 28*b* which forms a particular feature of the invention. The magnet pin 28*b* is received in a through bore 40 in a carrier in the form of a wheel 24*b* which is rotatably mounted in a bore 32 in the slide member 6. Four such wheels, 24*a*, 24*b*, 24*c*, 24*d* of equal size, each carrying a respective magnet pin 28*a*, 28*b*, 28*c*, 28*d*, and a fifth wheel 25 of larger size carrying a magnet pin 26 are provided in respective bores 32 in the slide member 6. The wheels are cog like and intermesh so that rotation of one wheel causes all five wheels to move. The larger wheel 25 has 1½ times the number of teeth of the smaller wheels 24*a*, 24*b*, 24*c*, 24*d*. The teeth of the wheels sit on ledges on the inner surface of the bores 32.

In operation of the lock, at any one time one of the magnet pins 28*a*, 28*b*, 28*c*, 28*d* forms a code-changing pin which is utilised to change the code of the lock, whilst the other pins 28*b*, 28*c*, 28*d* and 26 are locking pins, that is they form part of the lock code and project into respective apertures 13' in the lock plate 12 and must be repelled therefrom by the key 5 to unlock the lock.

Figure 4:
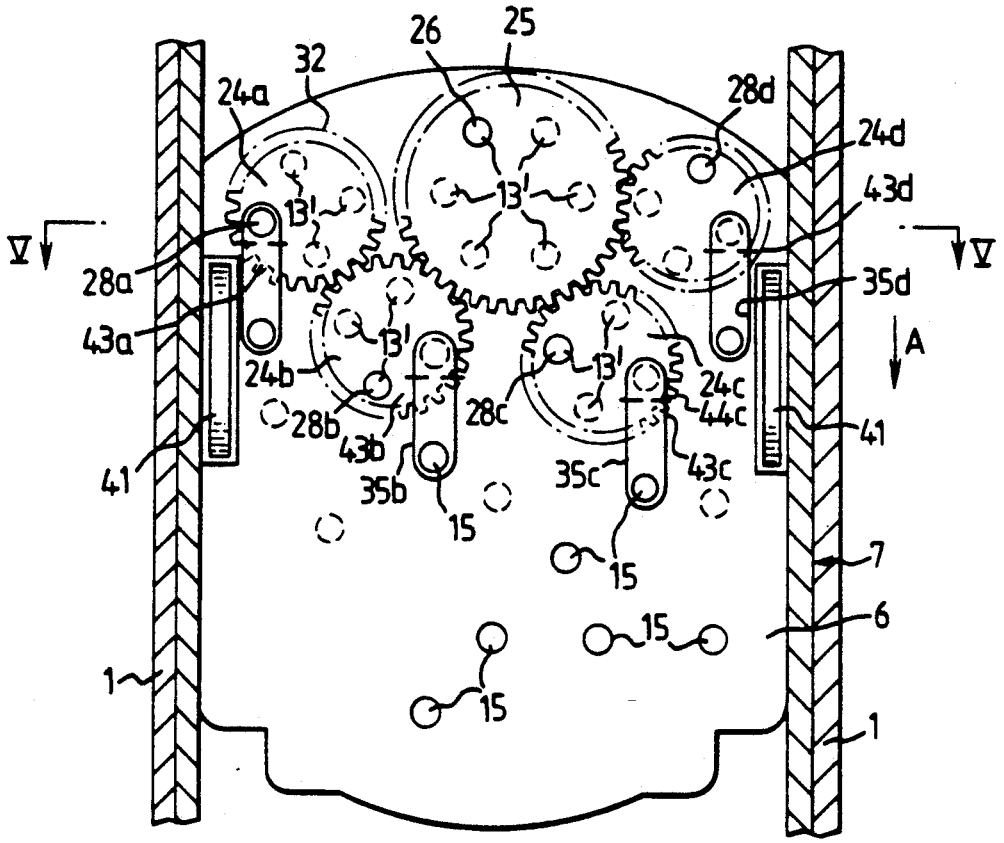
FIG. 4 shows a detail view of the lock with part thereof cut away to show a slide member of the lock.

Looking at FIG. 4, the magnet pin 28*a* is the code-changing pin. This pin 28*a* is utilised to rotate the wheel 24*a* and hence wheels 24*b*, 24*c*, 24*d* and 25 by 90 degrees so that all four pins 28*a*, 28*b*, 28*c*, 28*d* are moved through 90 degrees and pin 26 is moved through 60 degrees only due to the greater number of teeth on wheel 25. At this point (FIGS. 3 and 6) magnet pin 28*a* becomes a locking pin, magnet pin 28*b* is a code-changing pin and magnet pins 28*c* and 28*d* are locking pins. The disposition of the locking pins has thus been changed and so the code of the lock is changed.

The code-changing operation of the lock will now be described in more detail.

Let FIG. 4 show the lock with a first code and hence openable by a first key carrying the first code. The code-changing magnet pin 28*a* projects into an elongate slot 35*a* in the lock plate 12. When the first key 5(1) is inserted it repels locking magnet pins 15 and magnet pins 28*b*, 28*c*, 28*d* and 26 from their respective apertures in the lock plate 12. The key 5(1) does not repel code changing pin 28*a* which thus still projects into the elongate slot 35*a*. This pin is held in the slot by its attraction towards the guide plate 9, or a magnetic spot may be provided on the key to attract the pin more positively into the slot. The pin 28*a* slides in the slot 35*a* as the slide member 6 slides and hence the first key can operate the lock, the locations of the magnet pins 28*a*, 28*b*, 28*c*, 28*d* and 26 remaining constant as the lock is operated. Engagement of the pin 28*a* in the elongate slot 35 serves to prevent unwanted rotation of the wheels 24*a*, 24*b*, 24*c*, 24*d* and 25.

Figure 5:
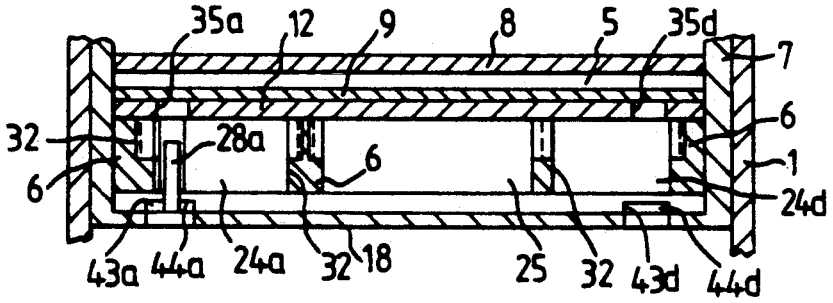
FIG. 5 is a cross-section along the line V—V of FIG. 4.

To change the lock code to a second code a second key 5(2) is inserted. This key has encoded on it the first code, the second code and a lock changing code. The first and second codes both include parts corresponding to the pins 15, that is to repel them. The first code repels pins 28*b*, 28*c*, 28*d* and 26 in the FIG. 4 position, and the second code repels pins 28*a*, 28*c*, 28*d* and 26 in the FIG. 5 position. The first lock changing code is a magnetic spot which, in the FIG. 4 position, repels the pin 28*a*.

As stated previously, pin 28*a* (and pins 28*b*, 28*c* and 28*d*) are located in bores 40 which are open at both ends. When the second key 5(2) is inserted it repels the pin 28 out the "back" of the respective bore 40 against a back wall 18 of inner casing 7. Accordingly as the second key is inserted it repels all the locking pins to unlock the slide member 6 using the first code, and it repels the pin 28*a*. The slide member 6 is free to move as the key 5(2) is pushed in further. As the slide member moves (in the direction of arrow A in FIGS. 4 and 6) the pin 28*a* engages an edge 44*a* of a tang 43 which is pressed from the back wall 18 of the inner casing 7. Thus, further movement of the slide member 6 causes the wheel 24*a* to be rotated, the pin 28*a* being allowed to move sideways across the abutting edge 44*a* of the tang 43*a*. When the slide member 6 is at the limit of its travel, the pin 28*a* has been moved through 90 degrees, as have the other pins 28*b*, 28*c*, 28*d* to the FIG. 6 position. Whilst the pin 26 in the larger wheel 25 is moved through 60 degrees only because of the ratio in the wheel diameters. Also, of course, coupling member 22 is moved to allow the latch or bolt to be retracted, and the slide member 6 is held in the unlocking position due to the action of cams 41.

Figure 6:
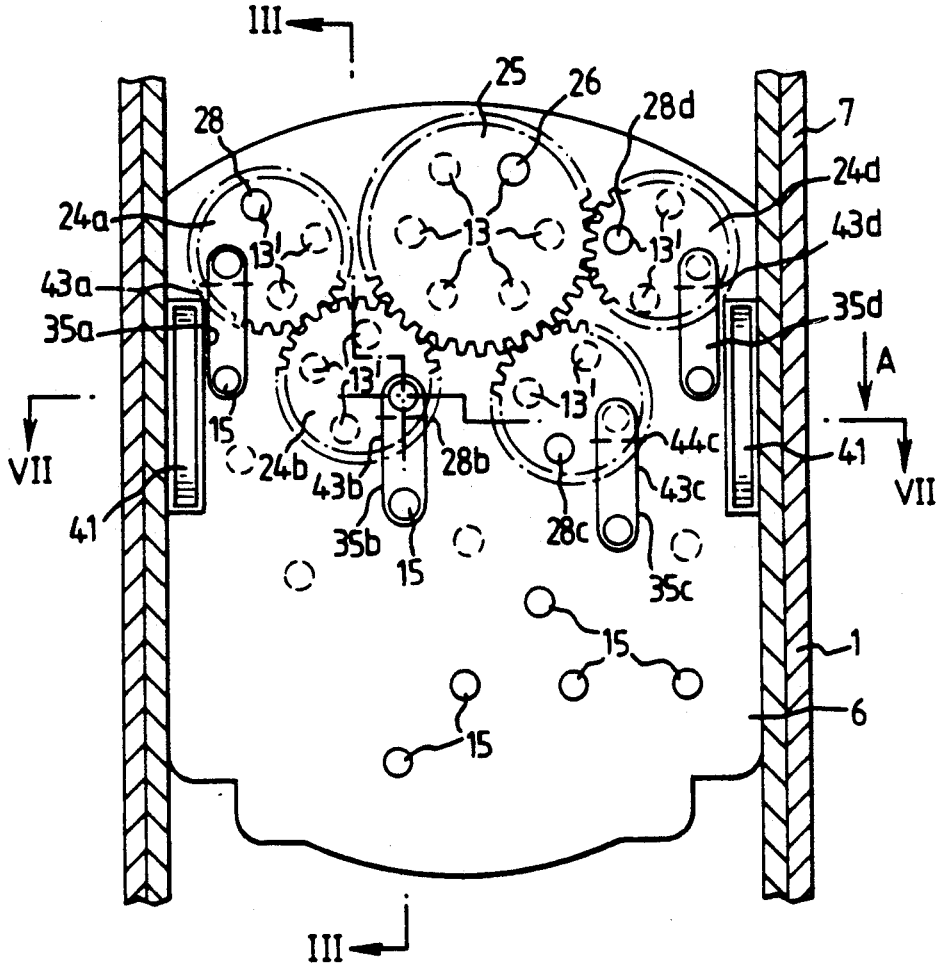
FIG. 6 is a detail view corresponding to FIG. 4 but with wheels of the lock rotated from a first position (FIG. 4) to a second position.
Figure 7:
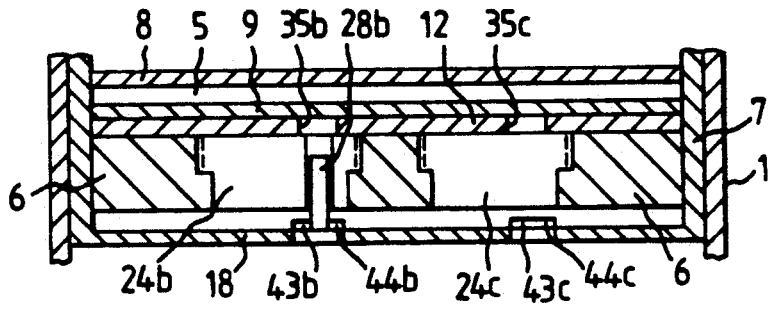
FIG. 7 is a cross-section along the line VII—VII of FIG. 6.
Figure 8A:
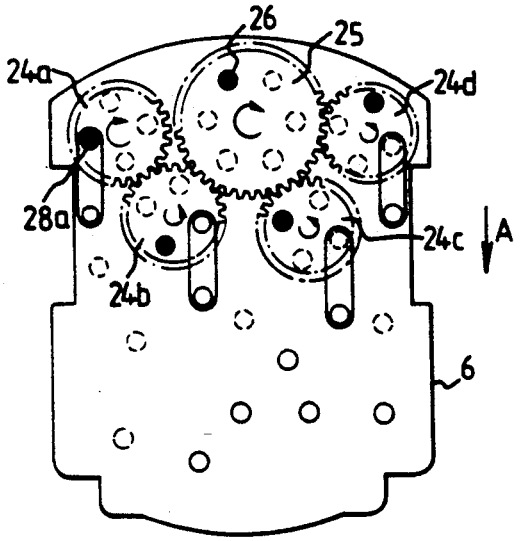
FIG. 8*a* to 8*l* shows schematically the 12 different lock codes of the lock of FIGS. 1 to 7.
Figure 8B:
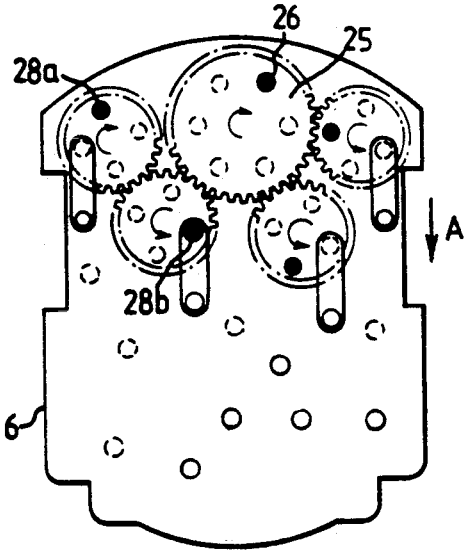
Figure 8C:
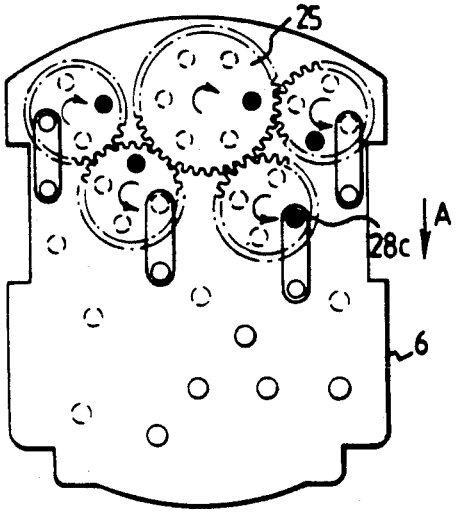
Figure 8D:
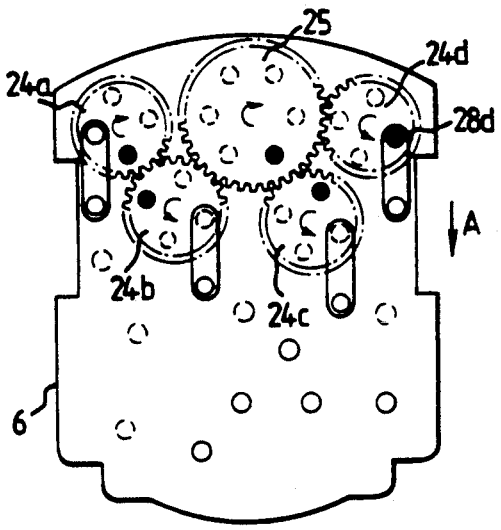
Figure 8E:
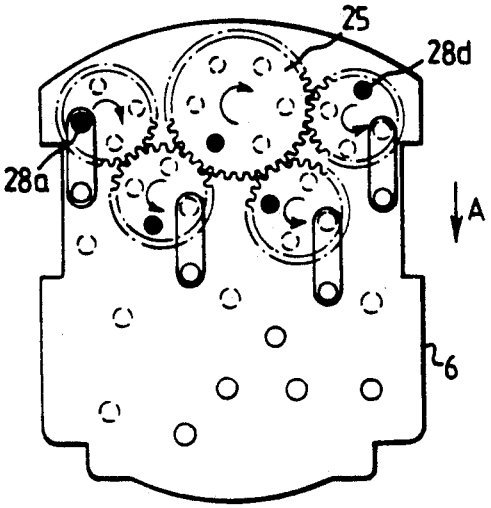
Figure 8F:
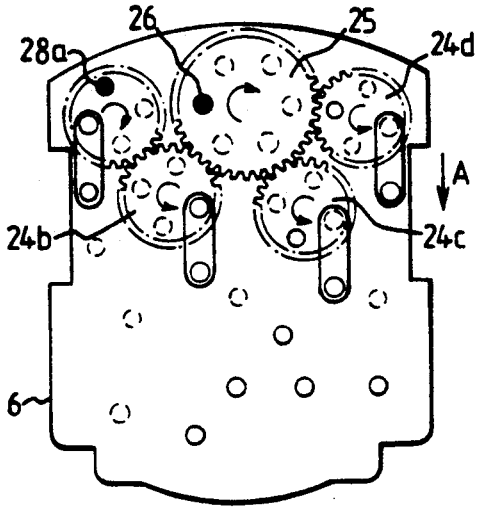
Figure 8G:
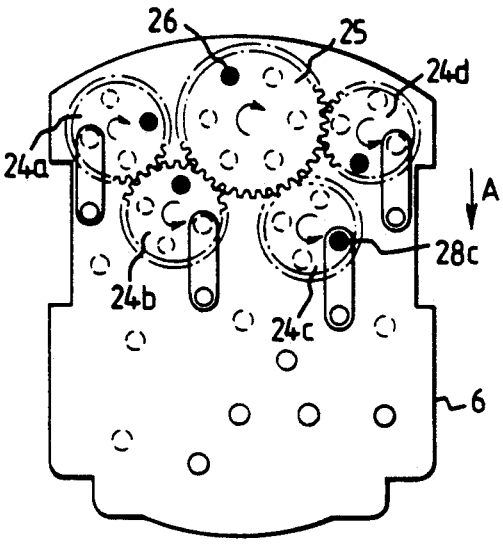
Figure 8H:
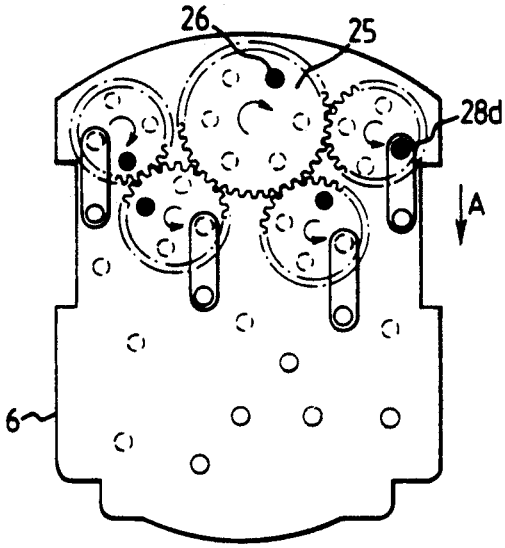
Figure 8I:
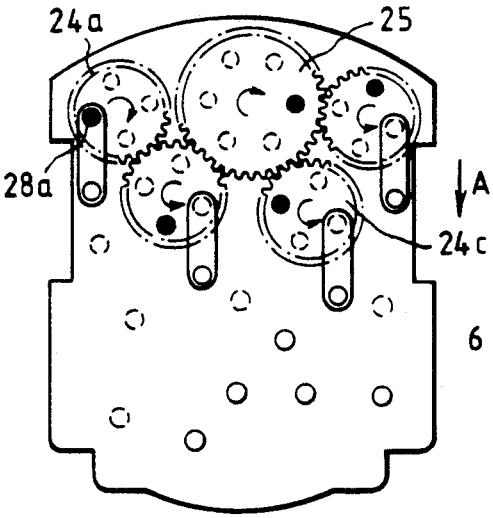
Figure 8J:
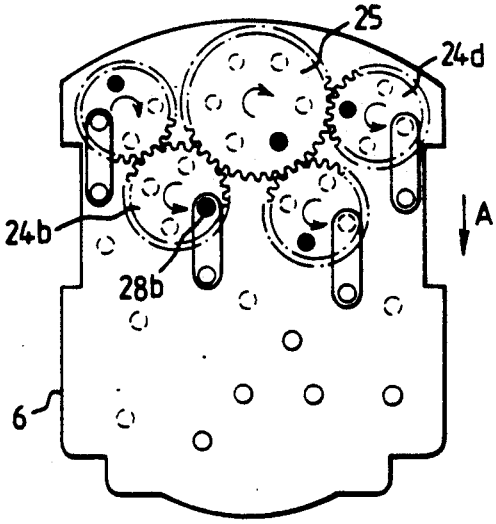
Figure 8K:
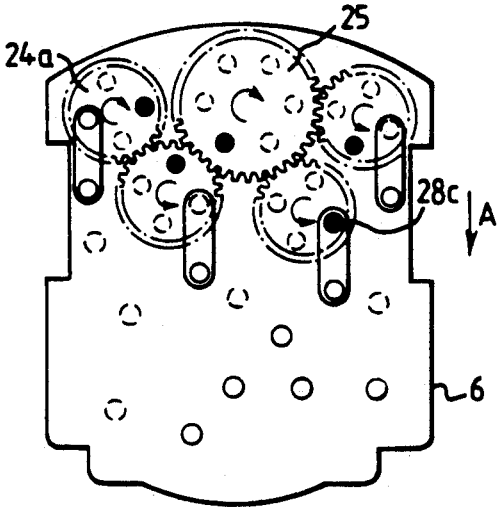
Figure 8L:
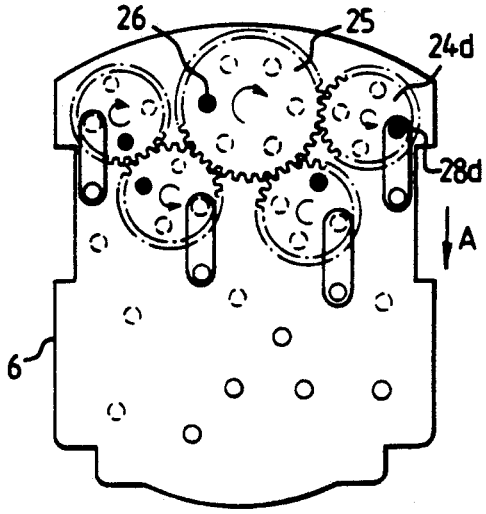

As the key 5(2) is withdrawn, the pins 28*a*, 28*b*, 28*c*, 28*d* are all attracted towards the magnetic plate 8. As the slide moves back to its locked position the second code changing pin 28*b* engages in a respective elongate aperture 35*b* in the fixed plate 12, the first code changing pin 28*a* is attracted into a respective locking aperture 13' and the pins 28*c*, 28*d*, 26 engage in respective (new) locking apertures 13', as seen in FIGS. 3 and 6.

At this time the lock can be opened again by a key bearing the second code, and, in particular, by the key 5(2) which carries the second code. Key 5(2) does not repel pin 28*b* in the FIG. 6 position and key 5(1) will not open the lock because its code does not correspond to the position of pins 28*c*, 28*d*, and 26.

Preferably key 5(2) has a magnetic spot to attract pin 28*b* to ensure that it locates securely in the elongate aperture 35*b* during movement of the slide 6.

To change the lock code from the second code to a third code, a third key 5(3) is used. Key 5(3) has the second lock code (to release the slide member 6), a lock changing code (to repel pin 28*b*) and the third lock code to allow it to open the lock after the code has been changed. As key 5(3) is inserted it releases the slide member 6, and repels pin 28*b* to engage the respective edge 44*b* of a tang 43*b* to cause wheel 24*b* (and wheels 24*a*, 24*c*, 24*d* and 25) to rotate as the slide member 6 is moved. The wheels thus adopt a new position where pins 28*a*, 28*b*, 28*d* and 26 form part of the third lock code and pin 28*c* is the new code changing pin. Thus keys 5(1) and 5(2) are eliminated.

A fourth key 5(4) changes the code from the third code to a fourth code by means of code changing pin 28*c* and a fifth key 5(5) changes the code from the fourth code to a fifth code by means of the code changing pin 28*d*. This eliminates keys 5(3) and 5(4). At this time it can be seen that the wheels 24*a*, *b*, *c* and *d* have turned a full circle, but that wheel 26 has turned only 240 degrees. Thus pin 28*a* once again is a code changing pin, but key 5(1) will not unlock the lock again because the locking pin in wheel 26 is in another position.

Accordingly a further 8 code changes can be made before all the magnet pins 28*a*, 28*b*, 28*c*, 28*d* and 26 are returned to their original (FIG. 4) position, i.e. three revolutions of the wheels 24 and two revolutions of the wheel 25. FIG. 8 shows the full twelve positions of the magnet pins. Hence the codes can be cycled through continuously but only in the prescribed sequence.

By forming the abutments or edges 44 from tangs 43, the tangs provide a ramp in the return direction of the slide member 6. Hence if a pin retracts from its elongate aperture during the return of the slide member and protrudes out the rear of the bore 40 it will simply ride up over the ramp, which will bring it back towards the attracting plate 8.

The wheel 24*a* is arranged to rotate in the opposite rotational direction to the other wheels 24*b*, 24*c*, 24*d*, and in particular to wheel 24*b*, so that slot 35*a* which is associated with the abutment 43*a* can be placed to one side of the lock plate 12 where it will not overlap the path of a magnet pin in the wheel 24*b*, since otherwise the wheels might inadvertently lock in an incorrect position due to a pin entering an incorrect elongate aperture. Similar considerations apply to the location of the locking apertures 13, 13'.

It will be appreciated that the abutments 44 are positioned to one side of the respective wheel axis, relative to the direction of movement of the slide, to ensure rotation of the wheel as the respective pin engages the abutment.

An abutment may be formed on a slant to provide a slight sideways impetus if the abutment is close to the line of movement of the wheel axis.

If desired, other users can be issued with keys corresponding only to the codes 1 to 12 which do not repel the respective code changing pins.

Management can have special keys which only change the code but need not subsequently open the lock and so need comprise only say, the first code and the code-changing code. Another use of this feature is in facilities requiring a key which is usable once only. The user may be issued a key, having the initial unlocking code and the code changing code, but not having the subsequent unlocking code. Hence, for example, when a key with code 1 is inserted it opens the lock and simultaneously changes the code to code 2, which cannot subsequently be unlocked by that key.

Various modifications may be made to the described embodiment. For example, the number of wheels may be changed and a wheel may carry more than one magnet pin. The ratio between the wheel sizes may be varied to obtain a different number of codes in a complete cycle of codes. Care must be taken however, because some arrangements may result in a key which can unlock more than one code in a complete cycle.

To increase the number of stationary locking pins, such a pin may be provided on the axis of rotation of a wheel, for example, the wheel 26 in the embodiment shown.

Figure 9:
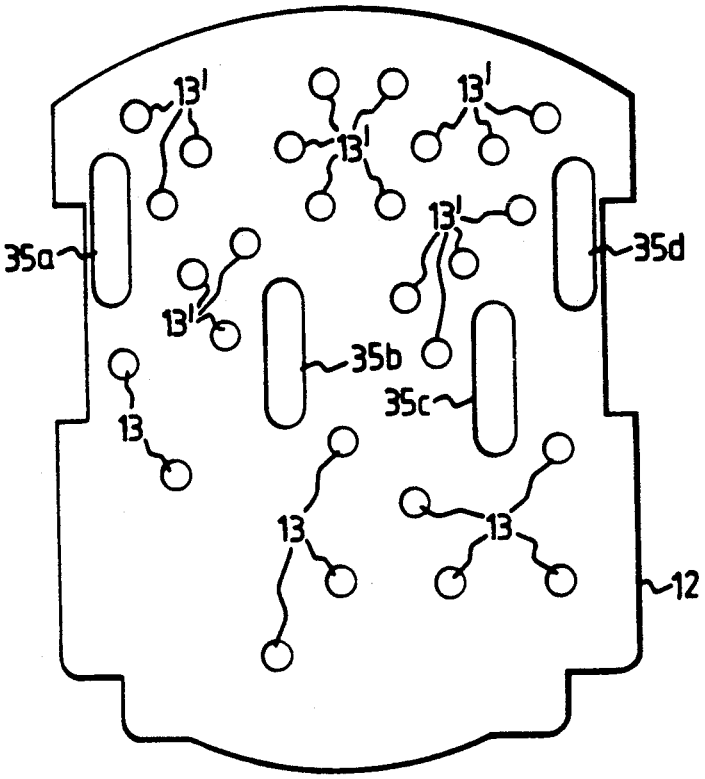
FIGS. 9 shows a plan of a lock plate for the lock of FIGS. 1 to 8.

FIG. 9 shows a plan of a lock plate for the embodiment of FIGS. 1 to 8.

In addition to the automatic code changing facility, the slide member 6 may include a manually rotatable wheel carrying a magnet pin, as described in EP0024242. If a maids key is lost, then a common code of the locks operated by that key can be changed by manually rotating the wheel.

It is possible to provide a variety of keys suitable for hotel use with the system of FIGS. 1 to 8. In particular a master or maids key, which will open the lock in any code but not change the code, and a recycle key to reset the lock to a particular code.

A maids key will have a code which will repel all the pins 15 and the pins 28, 26 at any of their locking positions but will attract the pins 28*a*, 28*b*, 28*c*, 28*d* at their code changing positions and so not cause any code change.

A recycle key will have a code which will attract pin 26 at one position and repel it at all others, and repel the pins 28*a*, 28*b*, 28*c*, 28*d* at their locking positions and their code changing positions. Repeated insertion of the key will cycle the lock through the codes until the key attracts the pin 26 when it will stop the cycle. Management will then know that the lock has been reset to one of two codes.

It is possible to arrange for a single wheel to provide a code changing function more than once per rotation. Such a wheel may comprise only code changing pins and be used to drive a wheel or wheels which carry locking pins.

By using wheels of different sizes, the number of rotations of the code changing wheel before a code is repeated can be made very large. The main limitation on such systems is the need to provide an adequate number of stationary pins to allow basic codes specific to users, that is buildings, and to floors of buildings, e.g. in hotels, without unduly increasing the lock size and the key size. Also it is necessary to ensure that as the slide moves, the path of a pin crosses only one locking aperture in the lock plate, i.e. the aperture specific to that pin. If the path of a pin crosses another, incorrect, aperture the pin may be attracted into that aperture when the key is removed, which may result in the slide being held in the unlocked position.

Particularly favourable combinations can be achieved by providing pins of opposing polarity in the wheels, although this can prevent master keying of the system with a single master key.

Further embodiments illustrating the above variations will now be described schematically. It will be appreciated that in all cases the basic code changing operation, by repelling (or attracting) a code changing pin, is the same and that other, stationary, locking pins are present.

Figure 10A:
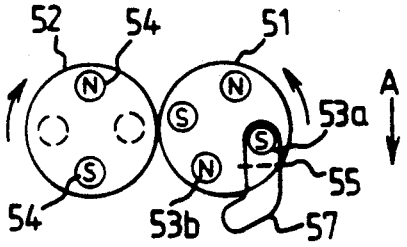
FIG. 10*a* to 10*d*, 11*a* to 11*f*, 12, 13 and 14*a* to 14*f* are schematic illustrations of other embodiments of the invention.

FIG. 10*a* shows a system using two wheels 51, 52 of equal size for producing a lock with four different codes. One of the wheels 51, is used to drive the other wheel 52. Wheel 51 carries 4 magnets 53 whose polarity alternates north and south around the wheel. Wheel 52 carries two magnets 54 of opposite polarity. A code changing edge 55 is located behind wheel 51 adjacent one of the bores in the wheel 51 and an elongate slot 57 is positioned in the lock plate (not shown) in front of the wheels 51, 52. The magnets 53 are used only for code changing, whilst the magnets 54 are used only for locking. Four apertures are provided in the lock plate above the stationary positions of the magnets 54 in the wheel 52.

To effect a code change, a key is inserted which releases the slide member, i.e., repels the magnets 15, 54. Movement of the slide in the direction of arrow A will cause the magnet 53*a* to engage the edge 55 and so rotate the wheel 51 anti-clockwise through 90 degrees as the wheels are moved with the slide. This brings magnet 53*b* to a position where it will engage in the elongate aperture 57 when the slide member returns and wheel 52 is also rotated through 90 degrees, to give a second locking code, FIG. 10*b*. The key can include the second locking code, i.e. spots corresponding to the new position of the magnets in wheel 52 and so will unlock the lock. However, the code changing code which repelled magnet 53*a* will now attract magnet 53*b*, which is of opposite polarity, into the elongate aperture 57 and so the lock code will not change again.

Figure 10B:
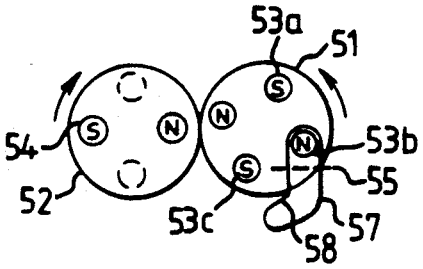
Figure 10C:
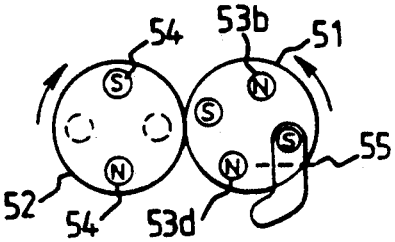

To change the code to the third code a key having the second lock code, i.e. repelling, inter alia, the pins 54 in the FIG. 10*b* position, and a code changing code, i.e. repelling the pin 53*b* is inserted in the lock. The key will also have a code to repel the pins 54 in the FIG. 10*c* position, which shows the third code.

Figure 10D:
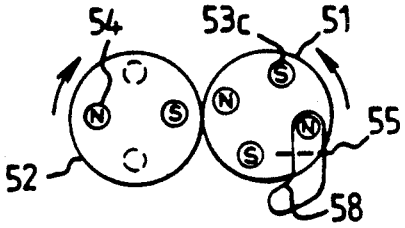

FIG. 10*d* shows the fourth lock code.

This embodiment illustrates a modification to the elongate slot. The slot is angled at its bottom end, in the direction of travel of the slide member, so that a magnet pin will come into the area of the slot even if the pin does not move fully through 90 degrees. This may occur, for example, if the slide member is not pushed down fully when opening the lock. If the pin enters the slot at the elbow 58 it will be guided round to its upper position as the slide is moved back. Preferably the magnet is a relatively tight fit in the upper end of the slot to ensure proper alignment of all the locking magnet pins with the lock plate apertures. By using the slot to complete the rotation of wheels in this way a greater degree of rotation can be obtained for a small travel of the slide member.

FIG. 11 shows an embodiment in which two code changing positions are provided for a wheel. A wheel 60 carries three magnets 61 spaced at 120 degrees and is stepped through six positions. The magnets are of different polarities (e.g. 1 north and 2 south) and engage in locking apertures in the lock plate when not at a code changing position. Code changing edges 62 are provided behind the wheel 60 at two adjacent stopping positions for the magnets, both positions being to the same side of a line through the center of the wheel 60 in the direction of movement. Referring to FIG. 11*a*, magnet 61*a* is at the code changing position and located in the top of the slot 63*a* in the lock plate. When the code is to be changed to the FIG. 11*b* position, a code changing key repels the magnet 61*a* and magnets 61*b* and 61*c*. Magnet 61*a* engages the rear edge 62*a* as the slide is moved in the direction of arrow A. This rotates the wheel through 60 degrees (the amount of rotation is limited by the extent of movement of the slide) so that the magnet 61*a* will enter the aperture 63*b* when the slide returns to the locked position. The same code changing key repels magnets 61*b*, 61*c* in their new positions but attracts magnet 61*a* in the FIG. 11*b* position so that it will open the lock in the new code but will not change the lock code when used again.

Figure 11A:
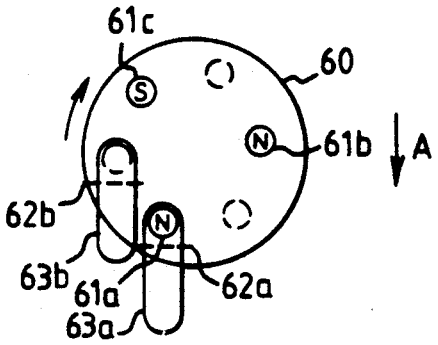
Figure 11B:
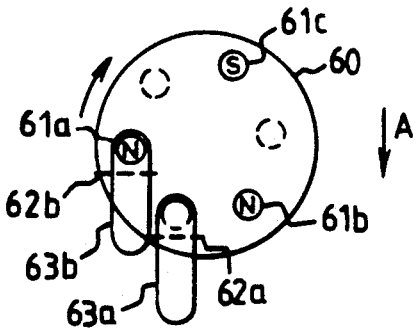
Figure 11C:
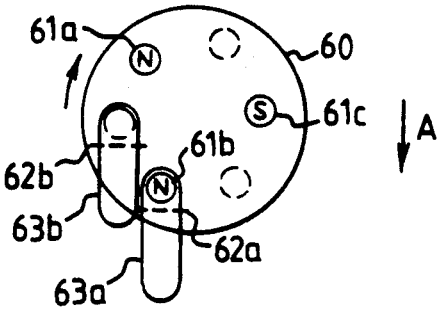
Figure 11D:
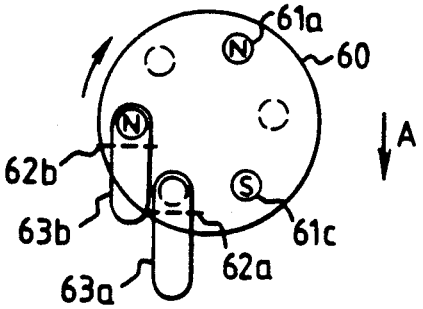
Figure 11E:
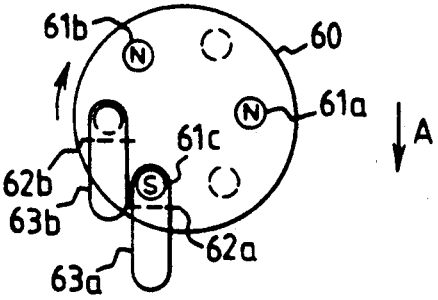
Figure 11F:
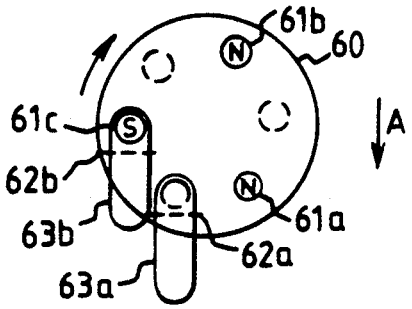

The next code changing key (2) must repel the magnet 61*a* in the FIG. 11*b* position, and also repel the magnets 61*b* and 61*c* in this position. The code is then changed to the FIG. 11*c* position where the magnet 61*b* becomes a code change magnet using edge 62*a*. The key (2) will then repel magnets 61*a* and 61*c* in the FIG. 11*c* position and attract magnet 61*b* to operate the lock but not change the code again.

The six codes can be cycled through as shown in FIGS. 11*a* to 11*f*, and the next change will return to the starting code 11*a*.

Figure 12:
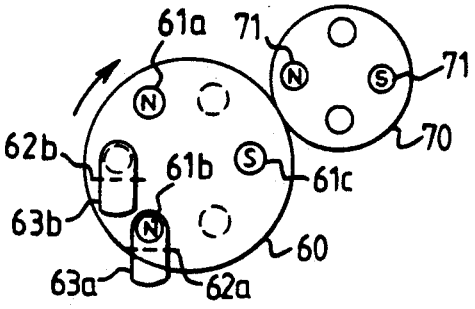

To provide a more complex coding the wheel 60 may drive a second wheel 70 which comprises only a locking magnet or magnets, as seen in FIG. 12. This wheel 70 is preferably of different size, having say ⅔ the number of teeth so that it steps through 90 degrees. Thus three rotations of the wheel 70 may be required for a complete cycle through 12 different lock codes. At least two magnets are preferred over 1 to prevent wheel 70 rotating in the event that the slide member is moved by a key which does not repel the (single) magnet in wheel 70 but does repel the pins in wheel 60.

A drawback of the system of FIGS. 11 and 12 is that a single full cycle master key cannot be provided because all locking positions at one time or another during the full cycle contain both north and south polarities and a single location on a key can only be one polarity.

Figure 13:
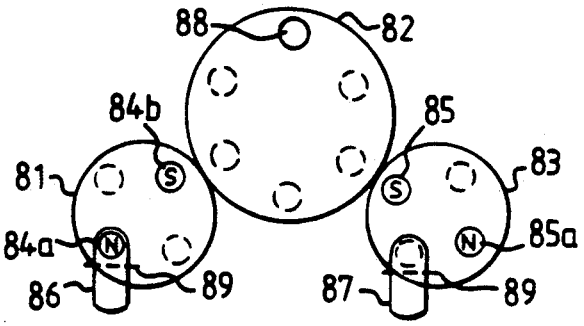

FIG. 13 shows another 12 code lock, utilising 3 wheels 81, 82, 83. Wheels 81 and 83 each carry two pins 84, 85 and have one code changing position as illustrated by the elongate apertures 86, 87 and edges 89. The third wheel 82 has 1½ times as many teeth as wheels 81, 83 and so moves through 60 degrees for each 90 degree rotation of the wheels 81, 83. The wheel 82 preferably carries 1 pin, two diametrically opposed pins of opposite polarity, or three pins spaced by 120 degrees with one pin of different polarity to the other pins. The number of pins and their polarities determining the number of code changes. The code changing pins on the wheels 81, 83 are brought into operation alternately. If for example, at least one of the small wheels 81, 82 carries magnets of opposite polarity and wheel 82 carries a single pin or two diametrically opposed pins of opposite polarity, the small wheel must complete 3 revolutions, i.e. 12 code changes, to return to the position shown in FIG. 13.

FIGS. 14*a*–14*f* show another embodiment of the invention which comprises a single wheel 90 having six positions through which it rotates. The wheel carries three magnets 91*a*, 91*b*, 91*c*. The wheel has two associated abutments 96, 97 for rotating the wheel 90 by means of a magnet pin located at either of two positions No. 4 and 5. A particular feature of this embodiment is that one of the abutments is provided on the lock plate, and the other is provided on the back wall 18 of the inner carrier 7.

Figure 14A:
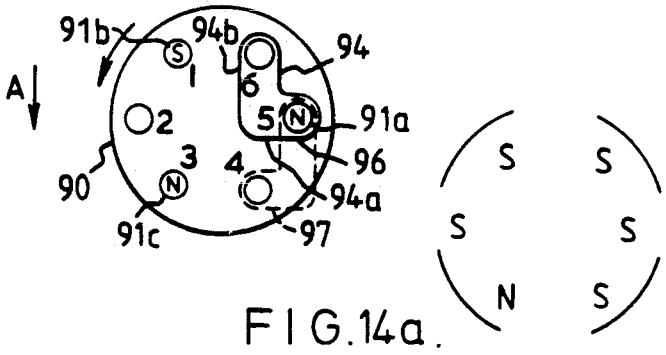

Referring to FIG. 14*a*, positions 1, 2 and 3 are used as locking positions, that is a magnetic pin in any one of these positions is a locking magnet pin. A magnet pin in one of the positions 4 and 5 is used to rotate the wheel, and hence change the lock code, specifically the location of a pin in the 1, 2, 3 positions.

A first L-shaped aperture 94 is cut into the lock plate, which is in front of the wheel as viewed in the drawing and a second reversed L-shaped recess 95 is formed in the wall 18.

Figure 14B:
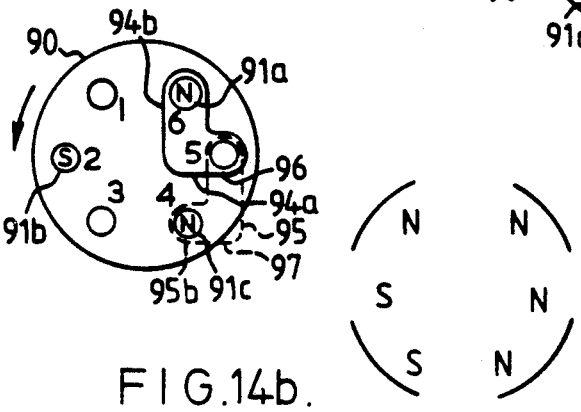

To change the lock code from the FIG. 14*a* position, a magnet pin 91*a* is attracted by an area of a code changing key (1) so that it projects into the lower arm 94*a* of the aperture 94 in the lock plate. The other magnet pins 91*b*, 91*c* (and 15) are repelled to release the slide member 6. Movement of the slide member in the direction of arrow A causes the pin 91*a* to abut the abutment 96 (the bottom edge of the arm 94*a*) and so the wheel is caused to rotate, the pin 91*a* moving along the arm until it is at the lower end of the vertical arm 94*b*. As the slide member 6 is released and returns the pin 91*a* slides up in the slot 94*b* (FIG. 14*b*). The wheel has thus rotated 60 degrees, bringing pin 91*c* into position No. 4. Pin 91*b* thus forms the only locking pin for the wheel.

Figure 14C:
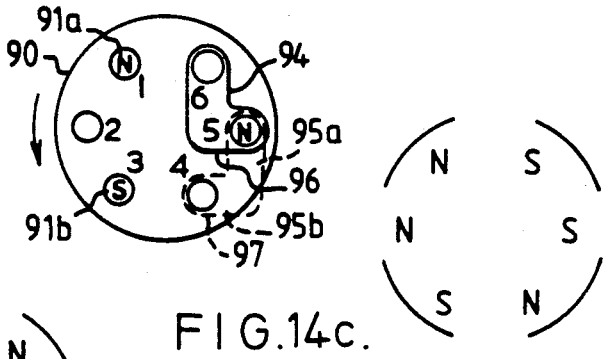
Figure 14D:
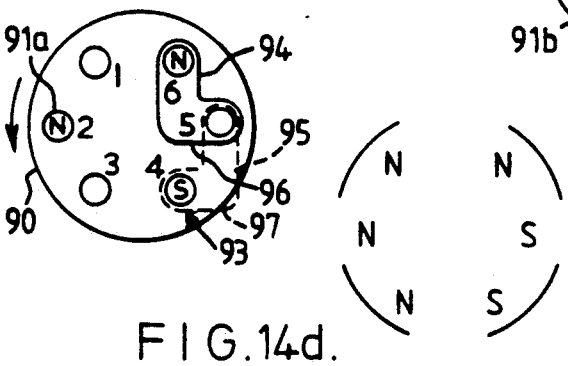
Figure 14E:
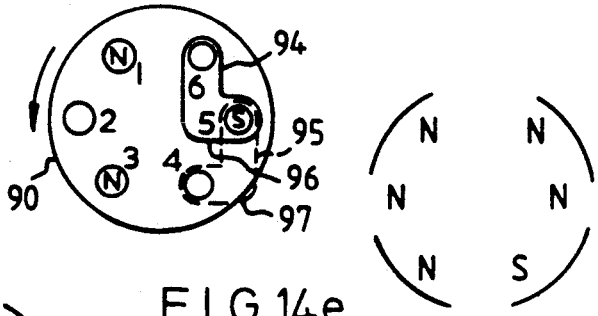
Figure 14F:
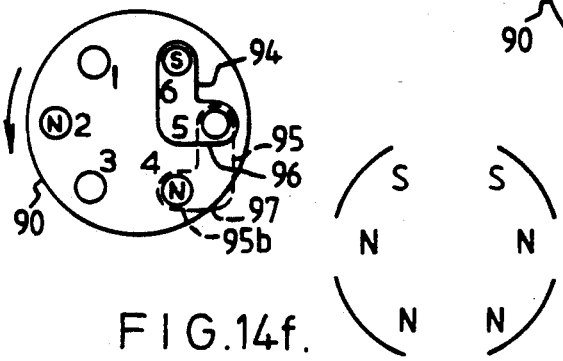

To change the code again a key (2) is inserted to repel pins 91*b* and 15 to release the slide member, to repel pin 91*a* to allow rotation of the wheel 90, and to repel pin 91*c* into the lower arm 95*b* of the slot 95. This time, the pin 91*c* will abut abutment 97 formed by the bottom edge of the rear slot 95*b* and so cause the wheel 90 to turn as the slide moves. Pin 91*c* moves into the No. 5 position and pins 91*a* and 91*b* form locking pins, as shown at FIG. 14*c*.

To continue to open the lock, but not change the code, the key (2) must repel the pin 91*c* so that it slides in the rear slot 95*a* during movement of the slide member, and also repel pins 91*a*, 91*b* at their new positions.

The polarities of the magnetic spots of keys which will change the lock code, and continue to open the lock but not change its code, are shown to the right hand side of FIG. 14.

Rotation of the wheel 90 thus provides 6 different lock codes. There is some cross-keying that is, a key with a magnet pin in position as shown in key (4) will open the lock in code 14*f*.

To provide a very large number of lock codes, a plurality of wheels 90 could be provided, the wheels being rotated independently of one another, to give 6×6 codes (2 wheels), 6×6×6 (3 wheels) or even more. Use of this system can eliminate cross-keying by having the key change a second wheel at that code.

A single master key or recycle key is not possible with this system.

In the particularly preferred embodiment of FIGS. 15 to 18 the abutments, for engagement by the code changing pins, are all formed in the lock plate. This can be particularly advantageous where the rear of the slide member serves another purpose, such as in U.S. Pat. No. 4,133,194 and it would be less convenient to have pins at a number of positions moving out the rear of the slide member.

The basic structure of the lock is as described for the embodiment of FIG. 1.

Figure 15:
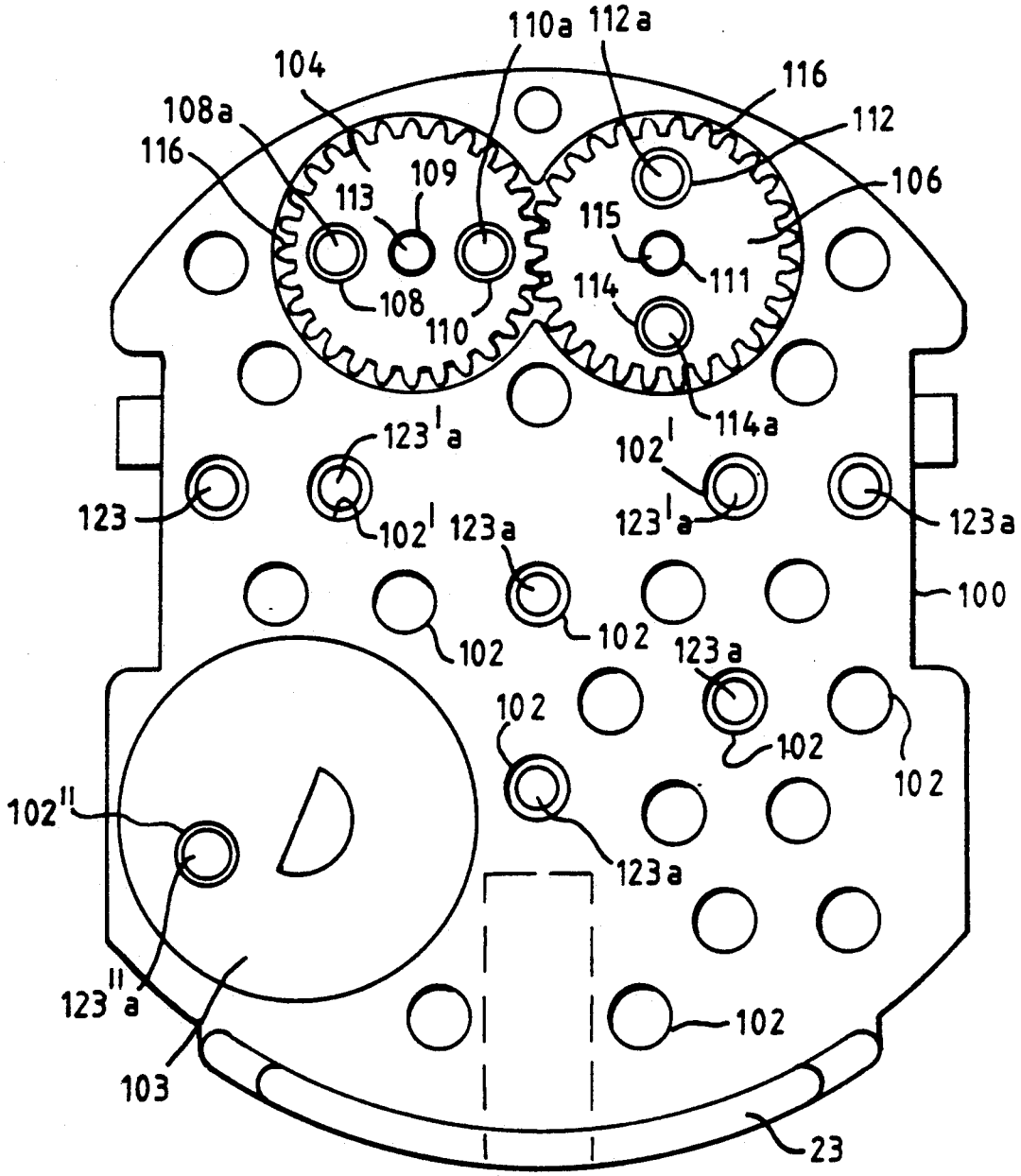
FIG. 15 is a plan view of a slide member of a lock forming a particularly preferred embodiment of the invention.

FIG. 15 shows a non-magnetic plastics slide member 100 which has a plurality of fixed-position blind bores 102 for receiving magnet pins 123*a*. A manually rotatable wheel 103 is provided in the slide member 100 and has a blind bore 102″ carrying a magnet pin 123″*a*. Wheel 103 operates in the manner described in EP 24242.

Two toothed non-magnetic plastics wheels 104, 106 are housed in blind recesses in the slide member 100. The wheels 104, 106 are each provided with two diametrically opposed blind bores 108, 110, 112, 114, and are meshed so that one pair of bores is ninety degrees out of phase with the other. Hence the bores 108, 110 in wheel 104 are aligned with the apices of teeth 116, whilst bores 110, 114 in wheel 106 are aligned with the troughs between the teeth 116. Each wheel 104, 106 has a through bore 109, 111 which receives a stub axle 113, 115 which is integral with the body of the slide member 100, the wheels 104, 106 rotating about the axles 113, 115.

Figure 16:
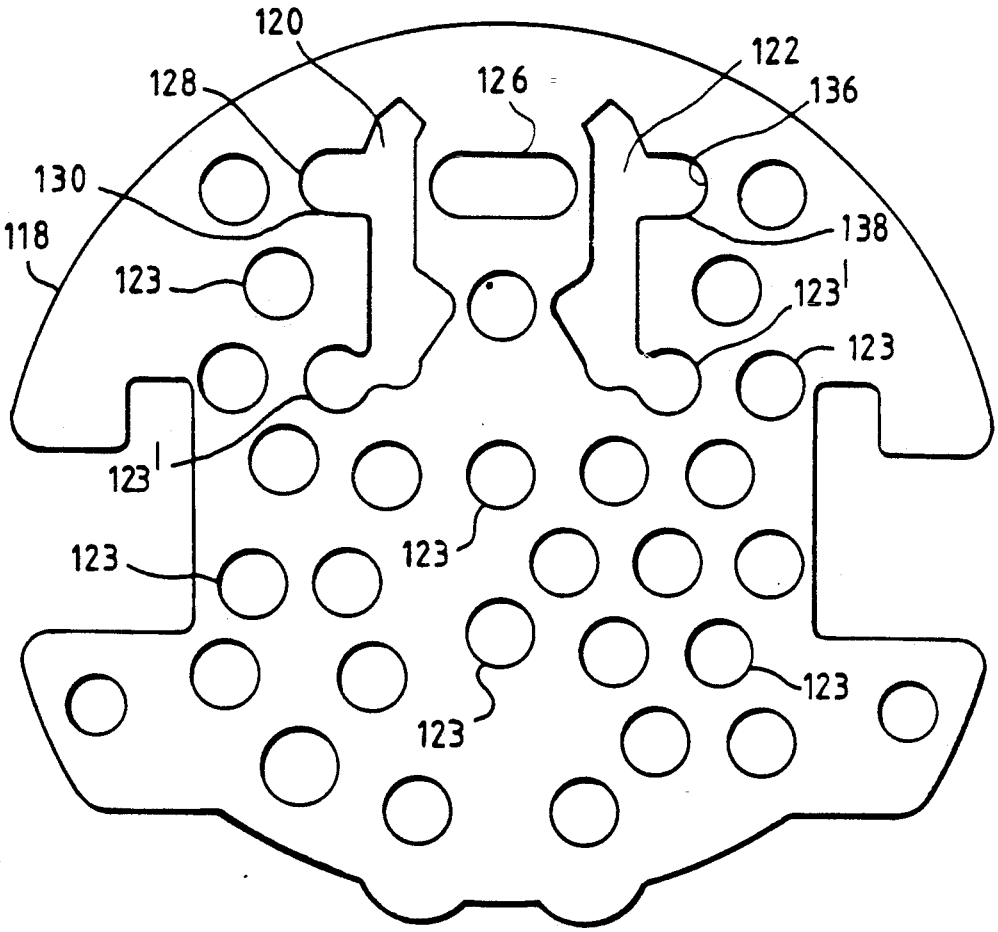
FIG. 16 is a plan view of a lock plate of the embodiment of FIG. 15.
Figure 17:
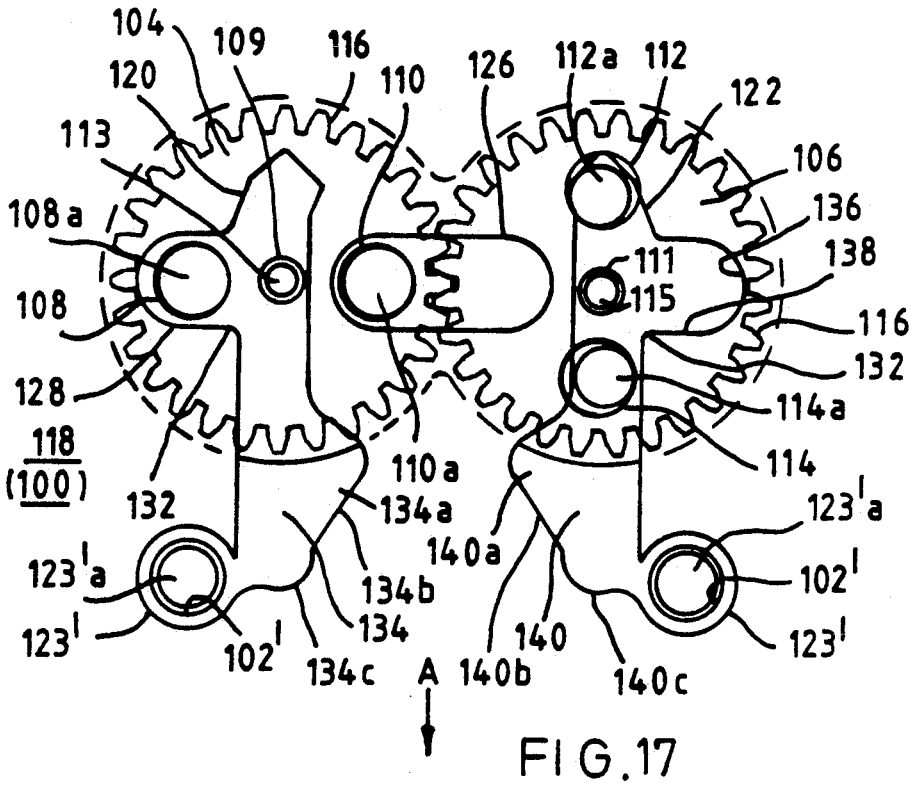
FIG. 17 is a detail of a plan view of the lock plate and slide member of FIGS. 15 and 16, the lock plate laying over the slide member (cf.

FIG. 16 shows a lock plate 118, and FIG. 17 shows a detail of the lock plate with the slide member 100 below it. With the slide member 100 in the locked position, code-changing magnet pins 108*a*, 110*a*, 112*a*, 114*a* carried by the wheels 104, 106 are attracted to the steel shield plate 8 (FIG. 3) and so project through the slots 120, 122 and 126. Other, fixed-position, magnet pins 123*a* project through respective apertures 123.

The lock plate 118 has symmetrically arranged slots 120, 122 which function as the abutments for engagement by code-changing pins. For convenience the bottom end (as pictured in the drawing) of each slot is formed as a locking aperture 123′ for receiving a locking pin 123′*a* in a corresponding bore 102′ in the slide member 100. A horizontal elongate aperture 126 serves as a locking aperture for an appropriately positioned magnet pin carried by the wheels 104, 106.

Figure 18A:
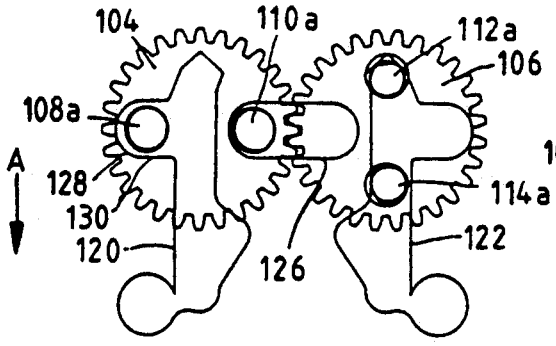
Figure 18B:
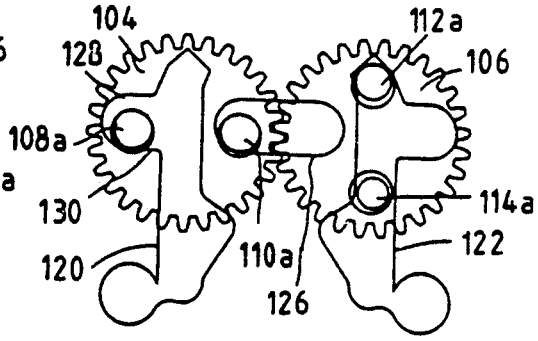
Figure 18C:
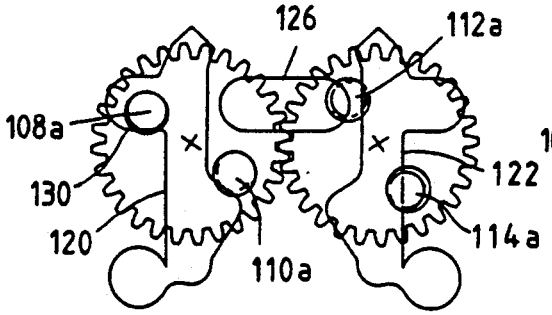
Figure 18D:
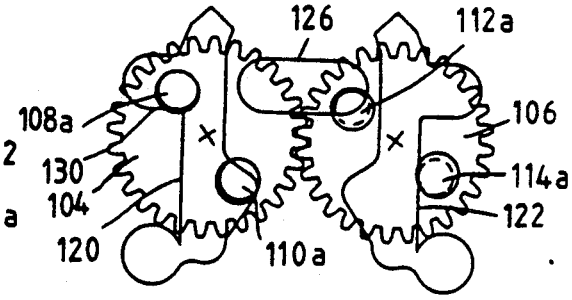

FIGS. 17 and 18*a* show the position with the slide member 100 in the locked position and wheels 104, 106 in the position of FIG. 15. Each bore 108, 110, 112, 114 carries a respective magnet pin 108*a*, 110*a*, 112*a*, 114*a*. In this position, the pin 110*a* projects into the aperture 126 in the lock plate, locking the slide member 100 relative to the lock plate 118. The pin 108*a* is also attracted into an ear 128 in the slot 120. The pin 108*a* abuts against a bottom edge 130 of the ear 128 in the event that the slide member 100 is urged downwards (FIG. 18*b*). This serves to balance the forces on the wheel 104, preventing it from tending to rotate whilst the pin 110*a* is in the slot 126.

The pins in bores 110, 112 of wheel 106 serve no locking function in the position shown, but are attracted into the slot 122, and so serve to prevent rotation of the two meshed wheels 104, 106.

Figure 18E:
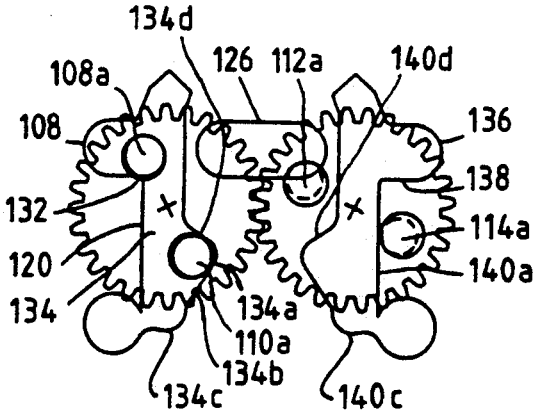
Figure 18F:
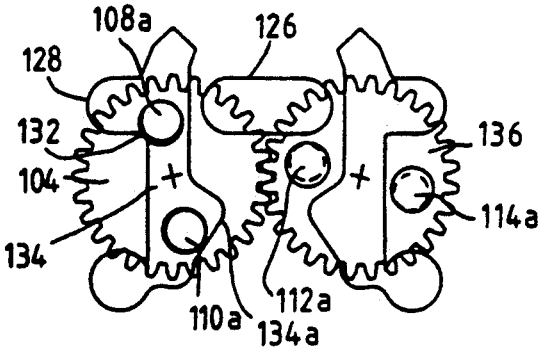
Figure 18G:
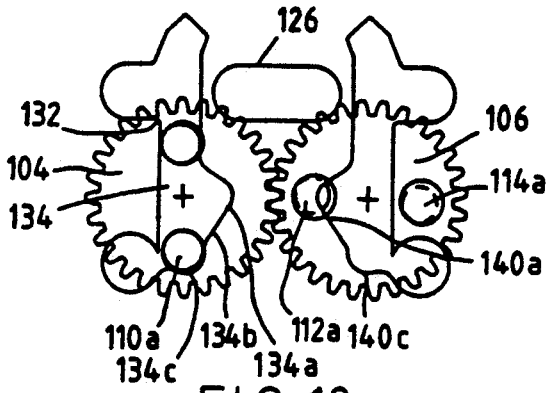
Figure 18H:
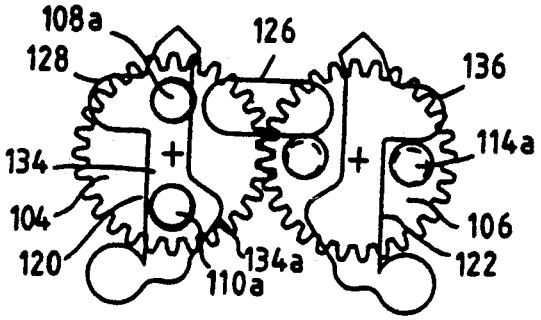

To change the code of the lock, a code change key (1) which repels the pins 110*a*, 112*a* and 114*a* and attracts the pin 108*a* is inserted in the lock. Once pins 110*a*, 112*a*, 114*a* are repelled the wheels 104, 106 are free to rotate. As with previous examples, the key (1) must also repel all the stationary locking magnet pins, including pin 123″*a* in wheel 103. As the slide member 100 is moved downwards by the key, arrow A, relative to the lock plate 118, the wheel 104 is caused to rotate due to pin 108*a* abutting abutment 130 (FIG. 18*b*). Pin 108*a* slides along the abutment 130, (FIGS. 18*b* to 18*d*) as the wheel 104 is caused to rotate clockwise, until the pin 108*a* is almost in the 12 o'clock position (FIG. 18*e*, 18*f*), when it rides over a lip 132 and enters a vertical channel 134, as the slide member 100 has neared the bottom of its travel. As seen in FIGS. 18*e* to 18*g* magnet 110*a* on clearing knee 134*a* of the slot 134 is attracted by a magnetic spot on the key 1 (see FIG. 19) and as the slide member continues to move downward the pin slides along the edge 134*b* of the slot 134 to aid in guiding the wheel to full 90 degree rotation. At this position (FIG. 18*g*), pins 108*a* and 110*a* are aligned with the vertical length 134 of the slot 130, pin 114*a* has been rotated around with wheel 106 (which has been rotated due to its geared connection to wheel 104) until it is aligned with but below an ear 136 of slot 122 and pin 112*a* is aligned with but below the locking aperture 126. The bottom edge region 134*c* of slot 134 is arcuate and forms a seat for pin 110*a* to properly position the wheels 104, 106 when the slide member reaches the end of its travel. Slot 122 has a similar arcuate edge region 140C.

As the slide member 100 is released to return to its locked position, the key (1) being withdrawn, the pins 108*a*, 110*a* are attracted into vertical portion 134 of slot 120, pin 114*a* will enter ear 136 and pin 112*a* enters locking aperture 126 (FIGS. 18*h* and 18*j*), due to the attraction of the steel shield plate 8 (see FIG. 1).

At the upper end of the travel of the slide member, (FIG. 18*j*) pin 108*a* is guided into the apex of the slot 120 to ensure that the wheel 104 remains with its two pins vertically aligned, the apex pressing on the pin 108*a* at this point.

Figure 18J:
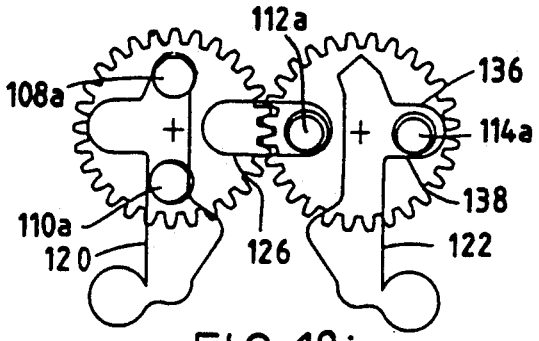
Figure 18K:
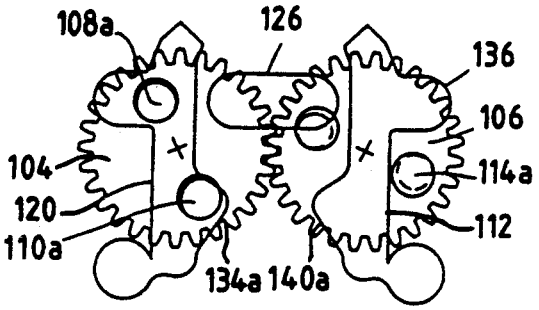
Figure 18L:
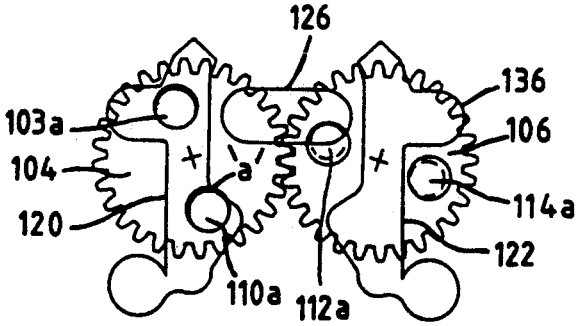

The slots 120 and 122 are shaped to ensure a code change even if the slide member is not pushed down the full distance. As described previously, when the slide member 100 is depressed by the key, the magnet pin that was immediately previously positioned in locking aperture 126 is rotated downwards and before the core is fully depressed the pin enters a knee portion 134*a*, 140*a* of elongate slot portion 134, 140 (FIG. 18*e*) and is attracted to a magnetic spot on the key 1. If the slide member is not depressed further but instead is allowed to return upwards to the locked position, the pin is urged by the cam action of the edge 134*d*, 140*d* of the slot above the knee 134*a*, 140*a*, to complete the rotation of the wheels through 90 degrees (FIGS. 18*k*, 18*l*, 18*j*).

If key 1 is to continue to unlock the lock, but not change the code again, it will have four additional magnetic spots to repel pins 114*a* and 112*a* in their new position and attract pins 108*a*, 110*a* in their new position. (If the key is not intended to open the lock, once the lock has been set to the new code, then the four additional magnetic spots are arranged to attract all the pins 108*a*, 110*a*, 112*a*, 114*a* in their new positions).

When the code of the lock is to be changed a second time, the second code change key (2) will have magnetic spots to repel pins 108*a*, 110*a* and pin 112*a*, as well as all other locking magnet pins 123*a*, and 123′*a*. Pin 114*a* is attracted so as to stay in the ear 136. As the slide member 100 moves downwards relative to the locking plate 118, the pin 114*a* abuts edge 138 of ear 136 and so causes the wheel 106 to rotate in the anti-clockwise direction. Pin 114*a* slides across the edge 138 until it is in the vertical channel 140 of slot 122. At this time pin 114*a* is aligned with the vertical channel 140, pin 110*a* is aligned with but below ear 130, and pin 108*a* is aligned with but below locking aperture 126. As the key is withdrawn and the slide member 100 returns to its locked position, pin 108*a* enters aperture 126 and pin 110*a* enters ear 130. If the key is to continue to open the lock (but not change the code), it will have magnetic spots to repel pins 108*a*, 110*a* in their (new) positions and attract pins 112*a*, 114*a*.

If each wheel has magnet pins of the same polarity, e.g. both pins in wheel 104 have exposed north poles and both pins in wheel 106 have exposed south (or north) poles, the lock will be back at the position of FIG. 18*a*. Thus only two codes are available and will alternate.

To have a four code cycle sequence for the lock, the pairs of pins in each wheel must be of opposite polarity.

Figure 19:
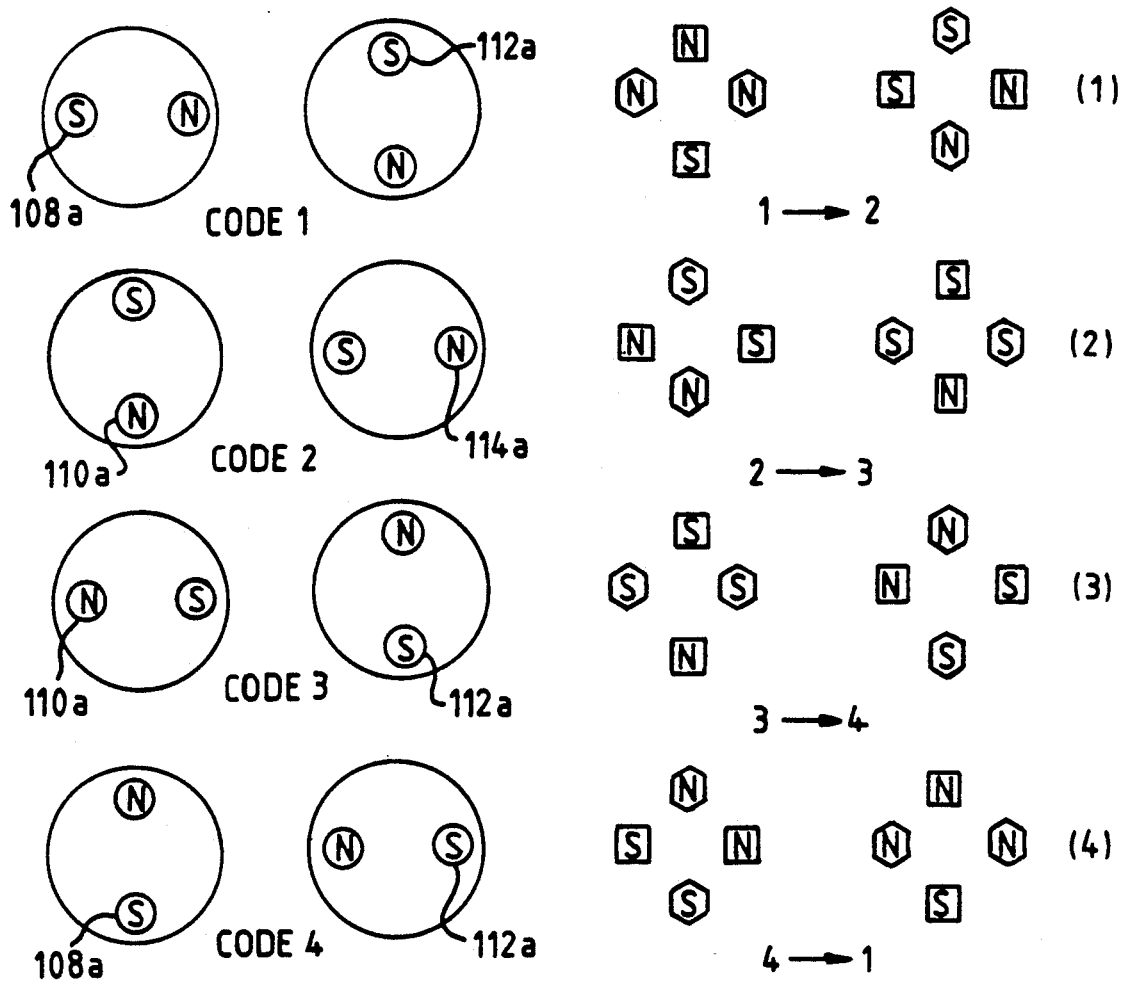
FIG. 19 illustrates lock codes and the corresponding key codes for the lock of FIG. 15.
Figure 19:
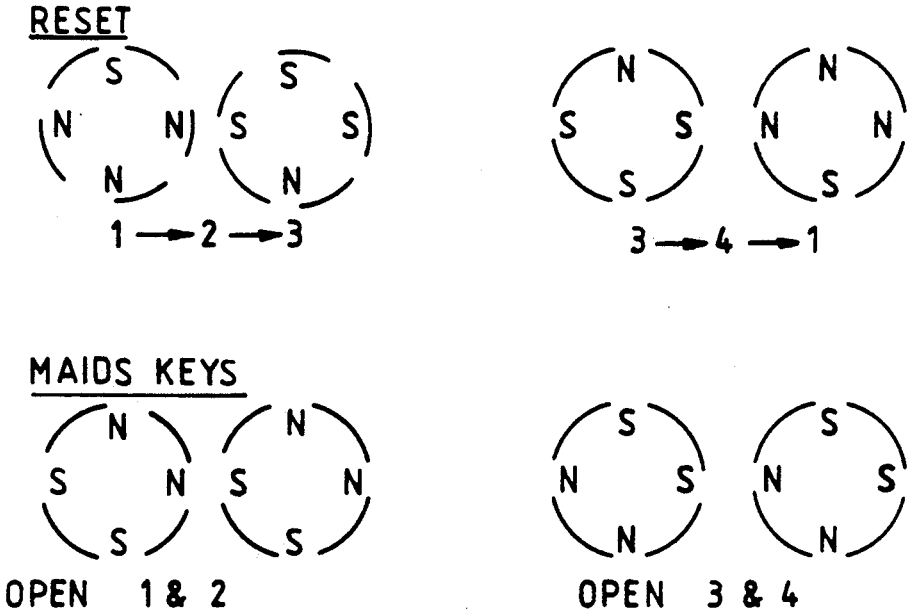

FIG. 19 shows schematically the position of the pins and the respective coding for keys with a four code system, using opposite polarity magnet pins in each wheel. Key codes are shown for keys which will change the code (once) and continue to unlock the lock, and the reset and maids keys are also shown. As shown, the poles of the magnet pins 108*a*, 110*a*, 112*a*, 114*a* are as viewed from the lock plate, and the poles on the key are the pattern on the "underside" surface of the key which faces the pins, when viewed from "above".

The slide member 100 shown has also a separate disc 103 of the type described in EP 24242 containing one locking magnet pin 123*a* which is manually movable by rotation of the disc 103 from outside the lock to any of four positions as described in EP 24242. After an automatic code sequence of four codes, manually rotating the disc 103 to another position will change the overall code of the lock and so another cycle of automatic code changes giving four more codes are possible, the lock having overall, a different set of codes to the previous sequence. In this manner a total cycle of 16 codes is possible, a manual change being made after each four automatic changes. The full cycle of 16 codes can be repeated, by rotating the disc pin to original starting position, or changing the position or polarity of any other fixed magnet 123*a* in the slide member can provide a further series of 16 codes.

With each sequence of four codes, two keys coded as "re-cycle keys" each changing the code once for each of two insertions can cycle the lock through the four codes: the first key will cycle from code 1 to 2, and then from 2 to 3 but it will not operate the lock again in code 3. The second key will cycle from code 3 to 4 and from code 4 to 1 but it will not operate the lock again in code 1. Thus only two recycle keys are necessary to reset the lock to any of the four codes. If these same keys master the four positions of the disc 103 they can be used to set the lock to any of the 16 possible codes, the positions of pin 123″*a* being determined by the manual rotation of disc 103.

This embodiment can also have a single-use key in which the key has a code to open the lock once, changing the code, and will not operate the new code. In this way a system in which keys open the lock only once can be provided. Two master keys which operate codes 1 and 2 and 3 and 4, but will not change the code, can also be provided. If they master the four positions of disc 103 they become grant masters for the system. A single master key is not possible as each location is occupied variously by a north or a south pole of a pin, and of course it is not possible to have different polarity spots at the same position on a key.

A system which is particularly useful for hotels makes use of an eight cycle sequence, i.e. two cycles of four automatically changed codes Nos. 1–4 and Nos. 5–8 by using two positions of the wheel 103, say the first position for codes Nos. 1–4 and the third position for Nos. 5–8. The second and fourth positions of wheel 103 would be used in the event that maid master keys, which open the lock in all eight codes of the sequence are lost: the wheel 103 being rotated to the second position to lock out the lost maids keys but allowing continuing use of guest codes Nos. 1–4, and rotated to the fourth position to allow continued use of guest codes Nos. 5–8. The guest keys Nos. 1–4 are coded to repel the pin 123″*a* in wheel 103 when it is in the first and second poitions, and keys Nos. 5–8 are coded to repel the pin when in the third and fourth positions. Hence it is not necessary to issue new guest keys when the maids keys are replaced, two sets of maids keys being possible with this system. When both sets of maids keys are lost, the system can be recoded by changing the position or polarity of one of the fixed position magnet pins.

It will be appreciated that a lock may incorporate two (or more) independently operable automatic code changing mechanisms. Thus if each system provided a cycle of 4 codes, a total of 16 automatically changeable codes could be achieved. The lock may incorporate two (or more) different embodiments of code changing mechanisms or two similar embodiments. A lock using the embodiments of FIGS. 4 and 13, for example, could have 120 different codes which can be cycled through automatically. The code changing keys would, preferably, operate only one of the code changing mechanisms at a time.

It will be appreciated that the code-changing mechanism need not be positioned in the upper part of the slide member, but may be positioned near the toe 23.

Various modifications may be made to the described embodiments and it is desired to include all such modifications as fall within the scope of the accompanying claims.

I claim:

1. A magnetic key operated lock, comprising a slide member movable from a locked position to an unlocking position with a magnetically coded key, a plurality of magnet pins slidable transversely of the slide member from a first position locking the slide member in said locked position to a second position unlocking said slide member on operation of the lock by a said magnetic key, the position and polarity of some or all of the magnet pins forming a code for the lock, at least one of said magnet pins in said lock being movable from a first location to a second location to change the code of the lock from a first code to a second code, wherein means for changing the lock code includes a magnet pin which is slidable transversely of said slide member by a code changing key so as to engage against an abutment during movement of the slide member between the locked and locking positions, and said abutment is formed by an edge of a ramp on a stationary plate in the lock.

2. A lock as claimed in claim 1, wherein the means for changing the lock code comprises at least one rotatably mounted carrier in said slide member, each having at least one magnet pin mounted therein.

3. A lock as claimed in claim 2, including at least two carriers wherein said carriers are in the form of wheels which are coupled together directly or through an intermediate wheel.

4. A lock as claimed in claim 2, wherein at least two magnet pins in a carrier carrying more than one magnet pin are of opposite polarity to each other.

5. A lock as claimed in claim 3, including means for rotating directly one of said carriers on insertion of said code changing key, said carrier in turn rotating the other carrier or carriers.

6. A lock as claimed in claim 3, wherein one of said carriers carries only magnet pins which form part of a lock code for the lock.

7. A lock as claimed in claim 3, wherein the at least two of said carriers are caused automatically to rotate through different degrees of arc on insertion of said code changing key.

8. A lock as claimed in claim 7, wherein at least one carrier is rotated through more than one complete rotation before the code of the lock is repeated.

9. A lock as claimed in claim 2, wherein a carrier is stepwise rotated to move the magnet pin through a plurality of positions and at least two abutments are provided to enable rotation of said carrier by means of the magnet pin when it is at any one of at least two respective positions corresponding to said at least two abutments.

10. A key for a lock as defined in claim 1 comprising a body carrying predetermined magnetic codes arranged with one code for unlocking the lock, one code for changing the lock code from one lock code to another lock code, and one code for continuing to unlock the lock after the lock code has been changed to the other lock code.

* * * * *

UNITED STATES PATENT AND TRADEMARK OFFICE

CERTIFICATE OF CORRECTION

PATENT NO. : 5,267,459

DATED : December 7, 1993

INVENTOR(S) : Bruce S. Sedley

It is certified that error appears in the above-indentified patent and that said Letters Patent is hereby corrected as shown below:

IN THE CLAIMS

Column 14, line 29, change "locking" to --unlocking--.

Signed and Sealed this

Twenty-fourth Day of May, 1994

Bruce Lehman

*Attest:*

BRUCE LEHMAN

*Attesting Officer*

*Commissioner of Patents and Trademarks*